United States Patent [19]

Snyder et al.

[11] Patent Number: 4,948,146

[45] Date of Patent: Aug. 14, 1990

[54] APPARATUS AND METHOD OF PLAYING A MENU ITEM COLLECTING GAME

[75] Inventors: Carol D. Snyder, East Aurora, N.Y.; Jeffrey D. Breslow, Highland Park, Ill.

[73] Assignee: Marvin Glass & Associates, Chicago, Ill.

[21] Appl. No.: 307,384

[22] Filed: Feb. 6, 1989

[51] Int. Cl.[5] ..... A63F 3/00

[52] U.S. Cl. ..... 273/273; 273/236; 273/276; 273/283; 273/1 R; 273/157 R

[58] Field of Search ..... 273/273, 276, 250–254, 273/157 R, 1 R; 434/127, 406

[56] References Cited

U.S. PATENT DOCUMENTS

| | | | |
|---|---|---|---|
| 2,458,966 | 1/1949 | Waldrop | 273/157 R |
| 3,817,531 | 6/1974 | King et al. | 273/157 R |
| 3,879,861 | 4/1975 | Grantham | 273/157 R |

FOREIGN PATENT DOCUMENTS

| | | | |
|---|---|---|---|
| 220795 | 8/1957 | Australia | 273/252 |
| 709543 | 5/1954 | United Kingdom | 273/252 |
| 1196482 | 6/1970 | United Kingdom | 273/254 |

*Primary Examiner*—Benjamin Layno
*Attorney, Agent, or Firm*—John S. Pacocha

[57] ABSTRACT

A game in which a number of players each attempt to collect all of the parts of a meal indicated on a menu allocated to each player at the outset of the game. No two menus are alike, but there is one part of the meal that is common to each of the menus. Other parts are common to some but not all of the menus. Each of the parts of the meal is displayed on one side of a commonly shaped, preferably pie shaped, piece. The pieces fit into cutout portions of a tray provided to each player. In addition to the menu item pieces, similarly shaped pieces have instructions on one side which cause players to trade pieces. All of the pieces are placed face down and each player in turn picks up a piece to obtain the needed parts of the meal. As each player picks and replaces unneeded items, the other players attempt to recall the location of items they need so that they can pick them on their next turn.

11 Claims, 1 Drawing Sheet

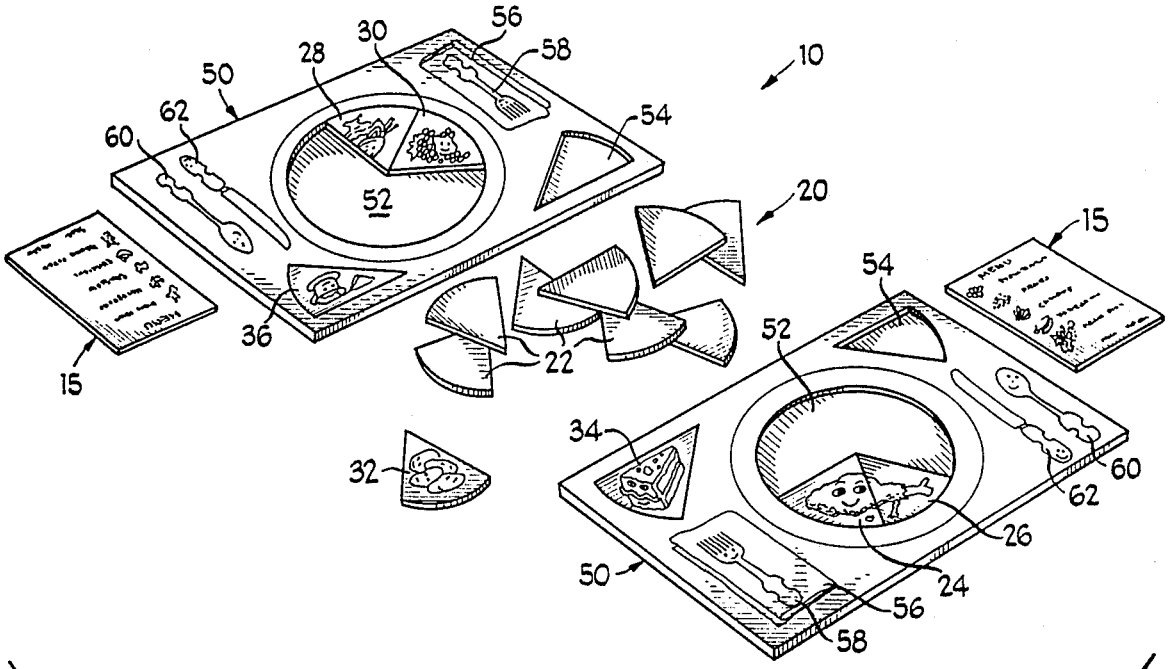
Fig 1
Fig 2
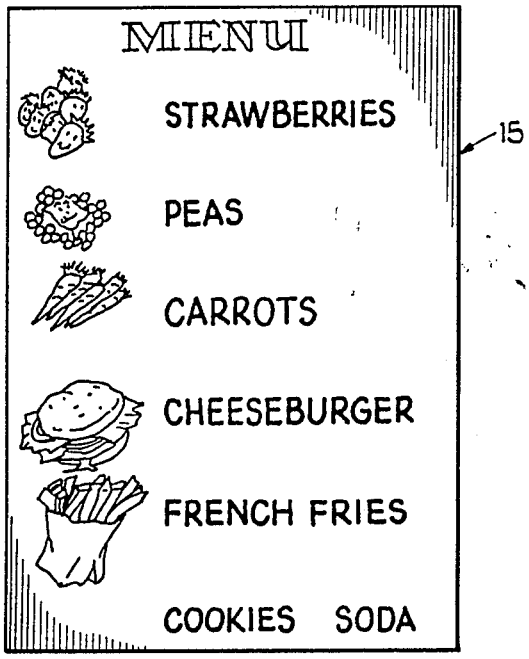
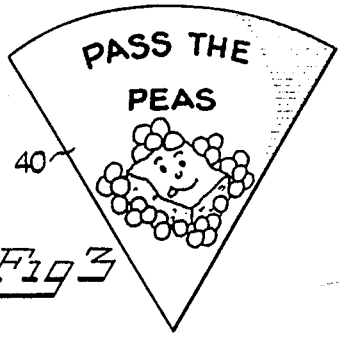
Fig 3
Fig 4
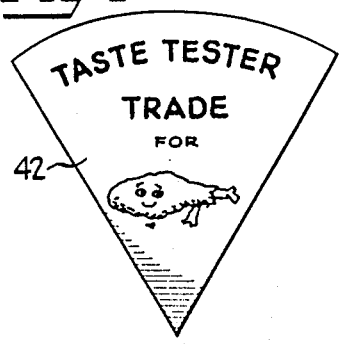

APPARATUS AND METHOD OF PLAYING A MENU ITEM COLLECTING GAME

BACKGROUND OF THE INVENTION

1. Field of the Invention

This invention relates generally to games and more particularly to games in which players recall the location of items and collect such items.

2. Background Art

Games in which players recall the location of items and collect such items are popular and help to develop the recognition and recollection skills of young children. Prior art examples of such games are the Milton Bradley Company's line of "MEMORY®" line of games as well as their "FRIENDS AT WORK" game. Parker Brothers "PIZZA PARTY®" game in which players use memory and matching skills to try and top off their own pizza slices with one kind of topping is another prior art example of games in which players recall the location of pieces that they are attempting to match; a "switch" token that is the same shape as the topping tokens direct the players to swap pieces with someone else. There are also other prior art games that involve collecting items, but do not require recollection. For example, in the Cadaco, Division of Rapid Mounting and Finishing Company "OH NUTS!" game, each player, using a special tool, tries to collect one of each of five colors of balls that are whirling around to fill cutout portions in an allocated card. In the game disclosed in U.S. Pat. No. 4,111,429 issued Sept. 5, 1978 to Waski, players control mechanisms for random selection of different colored marbles with each player attempting to collect a predetermined number of marbles of a color individual to that player plus one marble of a color common to all players. U.S. Pat. No. 3,817,531 issued June 18, 1974 to King et al., discloses a game in which players proceed around a game board path collecting parts of a picture that are removed to an individual player's tray for reassembly of the picture. There remains a need, however, for additional games in which players test their recognition and recollection skills.

SUMMARY OF THE INVENTION

The present invention is concerned with providing a game in which players use their recognition and recollection skills to collect all of the items indicated on a list allocated to each player at the outset of the game. While no two of the lists are alike, there is at least one item that is common to each of the lists and other items appear on some but not all of the lists. The items are all depicted on the face side of playing pieces that are of the same shape and have the same back. In addition to the items, the faces of some of the cards contain instructions causing players to trade the items. All of the pieces are placed face down and each player in turn picks up the piece to obtain the listed items. As each player picks and replaces unneeded items, the other players attempt to recall the location of items they need so that they can pick them on their next turn.

BRIEF DESCRIPTION OF THE DRAWINGS

For a better understanding of the present invention, reference may be had to the accompanying drawings in which:

FIG. 1 is a perspective view of an embodiment of the present invention;

FIG. 2 is an enlarged scale, plan view of the face of one of the lists used in the embodiment;

FIG. 3 is an enlarged scale, plan view of the face of one of the playing pieces; and FIG. 4 is an enlarged scale, plan view of the face of another playing piece.

DETAILED DESCRIPTION OF THE PREFERRED EMBODIMENT

Referring now to the drawings in which like parts are designated by like reference numerals throughout the several views, FIG. 1 shows a game 10 for a number of players. Each player is allocated a menu 15 that lists parts of a balanced meal. Thus, the exemplary menu shown in FIG. 2 lists strawberries, peas, carrots, cheeseburger, french fries, cookies and soda. Although each menu 15 itemizes a different meal, there is one item, conveniently peas, that is common to each menu. In addition, some items are common to more than one, but not all, of the menus.

Game 10 also includes a plurality of two sided playing pieces 20 that are all of the same configuration, conveniently pie shaped. Each playing piece 20 has a back 22 that is of the same design so that when the pieces are placed face down, one piece cannot be discerned from another. On the face of some of the pieces, there is a graphic depiction of part of a meal. Thus, the face of piece 24 shows half of a chicken leg while the other half is shown on the face of piece 26. Part of a cheeseburger is shown on the face of piece 28. The common peas are on the face of piece 30. Preferably, there are less peas pieces 30 than there are players. Cookies are shown on piece 32 and another dessert, in the form of cake, is shown on piece 34. A beverage is illustrated on piece 36.

Some of pieces 20 contain instructions causing the players to exchange pieces containing food and beverage items. As shown in FIG. 3, the face of card 40 instructs the player picking the card to "PASS THE PEAS" which are common to all menus 15. FIG. 4 illustrates the face of piece 42 which instructs the player that as a taste tester, the player may trade another player for the chicken pieces 24 and 26. Thus, the player picking a "TASTE TESTER" piece is able to obtain two pieces that the player may need for a single piece.

In addition to menus 15 and pieces 20, the game includes a tray 50 for each of the players. As illustrated in FIG. 1, tray 50 is generally rectangular and has a recessed circular cutout area 52 generally disposed in the center of the tray. The size of circular cutout area 52 is such that six of the pie shaped playing pieces 20 will fill area 52. Of the five entree items listed on menu 15, one of them such as the chicken or the cheeseburger will require two of the pie shaped playing pieces. Hence, six pie shaped pieces 20 are required to obtain all five of the entree items. Besides circular cutout area 52, each tray 50 includes two pie shaped cutout areas 54 of a size conforming to that of a playing piece 20. One of each of the cutout areas 54 is disposed adjacent one of the upper corners of each tray. Each tray 50 also includes graphic depictions of a napkin 56, fork 58, spoon 60 and knife 62.

To play the game, each player is allocated a menu 15 by deal or picking. All playing pieces 20 are placed face down in a central area that may be defined by surrounding it with the competing players trays 20. Each player proceeds, in turn, to pick a playing piece 20 to try and get an item called for on the player's menu. Upon picking a needed item, the player places it in the appropriate cutout area of the player's tray. When an instructional playing piece such as 40 or 42 is picked, the instructions are followed and the piece is then out of play. If a player picks a piece depicting an item that the player does not need, it is returned to the central pile. As pieces are returned to the pile, players try to recall the location of pieces that the players need to complete their menu. The first player to complete all of the items called for on the player's menu wins the game.

In the embodiment shown, menu 15 identifies the five entree items both graphically and by word but only identifies the dessert and beverage by word which may make it more difficult for some younger children. To introduce another level of difficulty of play, a variation may be employed where the players must complete the entree portion of their menu before being able to place the dessert and beverage called for by their menu in cutout areas 54 on their tray. To make play even more difficult, players may be required to collect the menu items in the order they are listed on the menu.

While a particular embodiment of the present invention has been shown and described with some variations, other variations and modifications will occur to those skilled in the art. It is intended in the appended claims to cover all such variations and modifications as fall within the true spirit and scope of the present invention.

What is claimed as new and desired to be secured by Letters Patent is:

1. A game for a number of players comprising in combination:

a plurality of playing pieces having a back side and a front side;

each of the pieces having identical size and shape;

the back side of all of the playing pieces being visually identical;

the front side of the playing pieces depicting an item to be collected by the players;

a list allocated to each player indicating a variety of items to be collected during play of the game;

each list being different from every other list;

one item being common to every list; and other items being common to some but not all of the lists.

2. The game of claim 1 in which two pieces are needed to complete some of the items.

3. The game of claim 2 in which the plurality of playing pieces include pieces having instructions permitting the players to trade a single playing piece for two of the playing pieces that make a single item.

4. The game of claim 1 in which the plurality of playing pieces includes pieces containing instructions permitting the players to trade pieces.

5. The game of claim 1 in which the plurality of playing pieces includes pieces containing instructions directing the players to pass a piece containing the common item.

6. The method of playing a game comprising the steps of:

allocating a different list calling for a variety of items to each player;

supplying a plurality of playing pieces having a common backside and depicting items to be collected by the players on the front side;

placing all of the pieces face down in a central pile; and each player, in turn, picking a piece in an attempt to obtain the items required by the allocated list.

7. The method of claim 6 including the step of providing pieces with instructions for the trading of pieces.

8. The method of claim 6 including the step of requiring the pieces to be collected in a particular order.

9. The method of claim 6 including the step of requiring two particular pieces to be collected to obtain a single item on the list.

10. The method of claim 9 including the step of providing pieces with instructions permitting a player to trade a single piece for two of the pieces required to complete a single item.

11. The game of claim 1 including a plural number of pieces, less than the number of players, that each depict the one item that is common to every list.

* * * * *